US007955063B2

(12) United States Patent
Mooy et al.

(10) Patent No.: US 7,955,063 B2
(45) Date of Patent: Jun. 7, 2011

(54) VANE PUMP

(75) Inventors: Robert H. Mooy, Georgetown (CA); Paul M. Morton, Oakville (CA)

(73) Assignee: Stackpole Limited, Mississaugo, Ontario (CA)

( * ) Notice: Subject to any disclaimer, the term of this patent is extended or adjusted under 35 U.S.C. 154(b) by 361 days.

(21) Appl. No.: 12/152,968

(22) Filed: May 19, 2008

(65) Prior Publication Data

US 2009/0285709 A1 Nov. 19, 2009

(51) Int. Cl.
*F03C 4/00* (2006.01)
*F04C 15/00* (2006.01)
*F04C 2/00* (2006.01)

(52) U.S. Cl. ..... 418/133; 418/26; 418/182; 418/259

(58) Field of Classification Search ..... 418/259, 418/266–268, 182, 133–134
See application file for complete search history.

(56) References Cited

U.S. PATENT DOCUMENTS

| | | | | |
|---|---|---|---|---|
| 2,635,551 | A * | 4/1953 | De Lancey | 418/26 |
| 4,342,545 | A * | 8/1982 | Schuster | 418/26 |
| 4,361,419 | A | 11/1982 | Vohringer | 418/73 |
| 4,558,998 | A * | 12/1985 | Kiyoshige et al. | 418/26 |
| 4,958,992 | A | 9/1990 | Winiger | 418/29 |
| 5,399,075 | A | 3/1995 | Frank et al. | 417/423.1 |
| 5,807,090 | A | 9/1998 | Agner | 418/135 |
| 5,964,584 | A | 10/1999 | Lorentz | 418/73 |
| 5,980,225 | A | 11/1999 | Sommer | 418/104 |
| 6,033,190 | A | 3/2000 | Merz | 417/302 |
| 6,422,845 | B1 * | 7/2002 | Wong et al. | 418/133 |
| 6,481,990 | B2 * | 11/2002 | Wong et al. | 418/133 |
| 6,558,132 | B2 * | 5/2003 | Hanggi | 417/220 |
| 2006/0222512 | A1 | 10/2006 | Hansen | 417/219 |

* cited by examiner

*Primary Examiner* — Theresa Trieu

(74) *Attorney, Agent, or Firm* — J.A. Thurnau, Esq.; T.A. Dougherty, Esq.; P.N. Dougherty, Esq.

(57) ABSTRACT

A vane pump comprising a case, a rotor disposed in the case, the rotor having a bore, a plurality of vanes radially moveable with respect to the rotor extend from the rotor, a drive shaft engaged with the bore, a second shaft fixedly connected to the case and extending from the case to slidingly engage the bore, a land extending from each end of the rotor, each land cooperating with the case to seal a fluid flow, and each land further axially controlling a rotor position within the case by a sliding engagement, and the drive shaft retainable in a predetermined position with respect to the case.

7 Claims, 5 Drawing Sheets

VANE PUMP

FIELD OF THE INVENTION

The invention relates to a vane pump, and more particularly, to a vane pump having a rotor having a position that is axially controlled between case cavity walls and a shaft engaged with the rotor.

BACKGROUND OF THE INVENTION

Pumps are staple engineering components used in a variety of applications to transfer fluid. They are available in a wide range of sizes and capacities to suit particular applications. One typical application is that of supplying lubricating oil in an automotive engine. Vane pumps are used widely in engine oil and transmission oil pumping applications. Vane pumps comprise vanes slidably engaged with a rotor. The vanes move radially in the rotor while also sliding along the inner surface of an eccentric cavity in a pump casing.

In engine oil applications the reliable operation of the pump is paramount to avoid catastrophic failure of the engine. On the other hand a reduction in both the cost, weight and energy requirements of the pump is demanded to meet automotive manufacturer's objectives.

Conventionally, pumps have a rotor supported within a housing on a pair of bearings. The bearings are located on opposite walls of the housing and the rotor has an integral shaft supported in those bearings. The shaft is usually press fit into the rotor which can cause significant stress to be imposed on the rotor. This arrangement may require an exotic material to withstand the stresses caused by the press fit while ensuring torque transmission at cold temperatures. It also requires careful alignment of the bearings that are located in independent housings of the pump to permit the shaft to be rotated freely within the bearings. Any misalignment in the bearings can cause the rotor to be tilted within the housing, causing premature wear and/or increased or decreased clearance with a consequent loss of efficiency or mechanical drag. Similarly, misalignment of the bearings imposes side loads upon the shaft which inhibits rotation and increases the torque required to drive the pump and thereby an increase in fuel consumption when used in an automotive environment. As such the conventional pumps do not readily meet the increasingly stringent requirements for enhanced efficiency and lower costs.

Representative of the art is U.S. Pat. No. 5,964,584 discloses a vane pump for liquids is comprised of a slotted rotor supported in a stator, wherein radially displaceable vanes are slidingly disposed, which can be pressed slidingly supported while acted upon by centrifugal force, spring tension or otherwise by compressive force against a stator inside wall, in said process delivery cells are formed which expand or narrow in a crescent-like fashion and the entry of the liquid takes place through a hollow concentric stator and the filling of the vane cells from the inside to the outside. The rotor is shaftless and of tubular construction, both sides are extended beyond the operating area determined by the vanes and the rotor is supported with the extensions in the outer stator, while the rotor possesses continuous vane slots from the internal to the external diameter. In the area of the rotor extensions, the frame of the stator possesses on its surface hydraulic effective surfaces acted upon by the operating pressure and/or pressure-relieved directed against the rotor for the at least partial compensation or avoidance of radially occurring forces.

What is needed is a vane pump having a rotor having a position that is axially controlled between case cavity walls and a shaft engaged with the rotor. The present invention meets this need.

SUMMARY OF THE INVENTION

The primary aspect of the invention is to provide a vane pump having a rotor having a position that is axially controlled between case cavity walls and a shaft engaged with the rotor.

Other aspects of the invention will be pointed out or made obvious by the following description of the invention and the accompanying drawings.

The invention comprises a vane pump comprising a case, a rotor disposed in the case, the rotor having a bore, a plurality of vanes radially moveable with respect to the rotor extend from the rotor, a drive shaft engaged with the bore, a second shaft fixedly connected to the case and extending from the case to slidingly engage the bore, a land extending from each end of the rotor, each land cooperating with the case to seal a fluid flow, and each land further axially controlling a rotor position within the case by a sliding engagement, and the drive shaft retainable in a predetermined position with respect to the case.

BRIEF DESCRIPTION OF THE DRAWINGS

The accompanying drawings, which are incorporated in and form a part of the specification, illustrate preferred embodiments of the present invention, and together with a description, serve to explain the principles of the invention.

DETAILED DESCRIPTION OF THE PREFERRED EMBODIMENT

Figure 1:
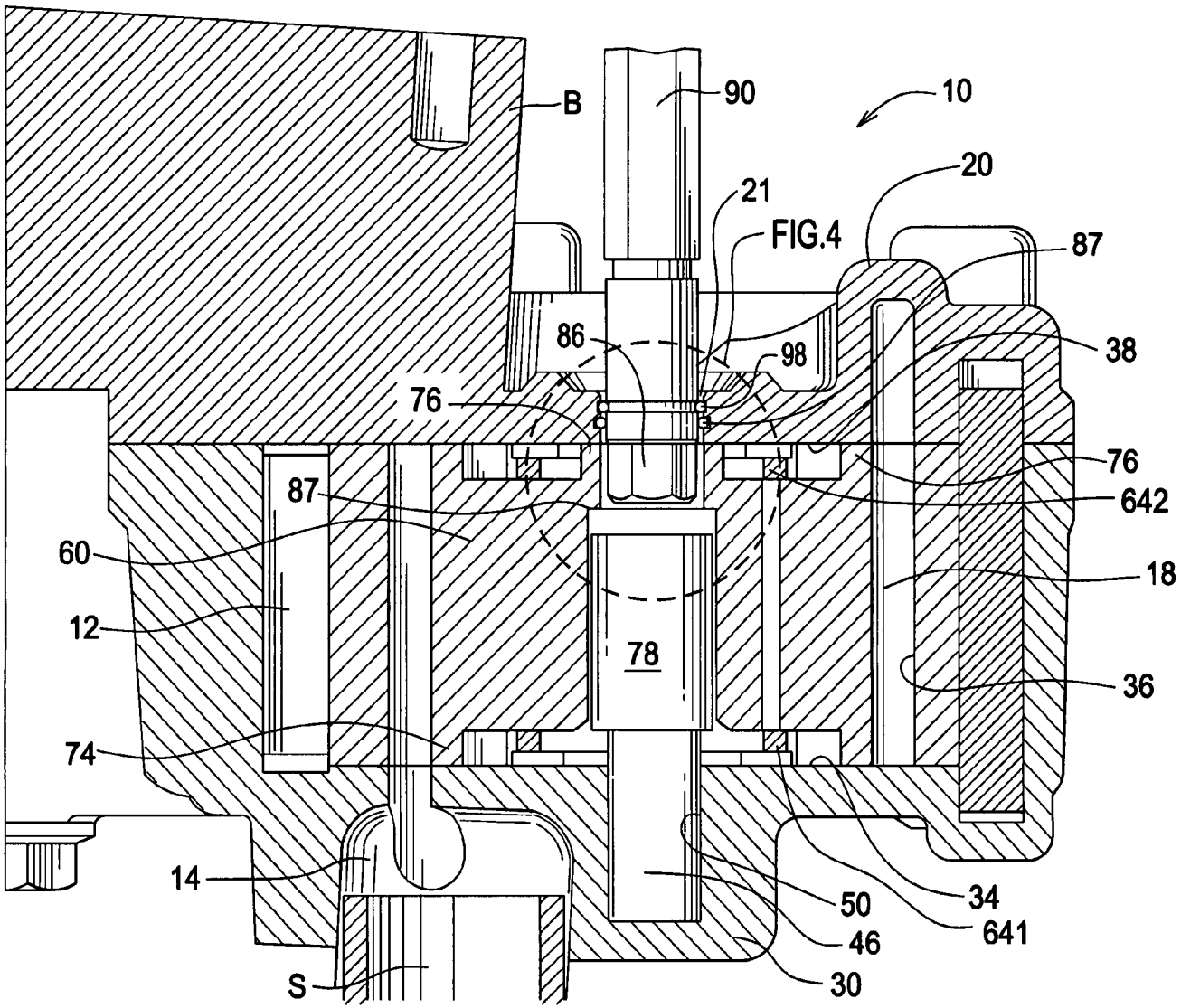
FIG. 1 is a cross-sectional view of the vane pump installed on an internal combustion engine.

FIG. 1 is a cross-sectional view of the vane pump installed on an internal combustion engine. Pump 10 is mounted to an engine block B. Pump 10 delivers oil from an outlet 12 to internal oil galleries G. Oil is supplied from a sump S to the pump suction at inlet 14.

Pump 10 is driven by drive shaft 90. Drive shaft 90 is connected to a camshaft (not shown) or similar engine power take-off. The details of the engine form no part of the invention and the supply of oil to the pump and the delivery of oil from the pump 10 is per engine requirements.

A hydraulic seal known in the art is disposed between shaft 90 and inner surface 22.

Figure 2:
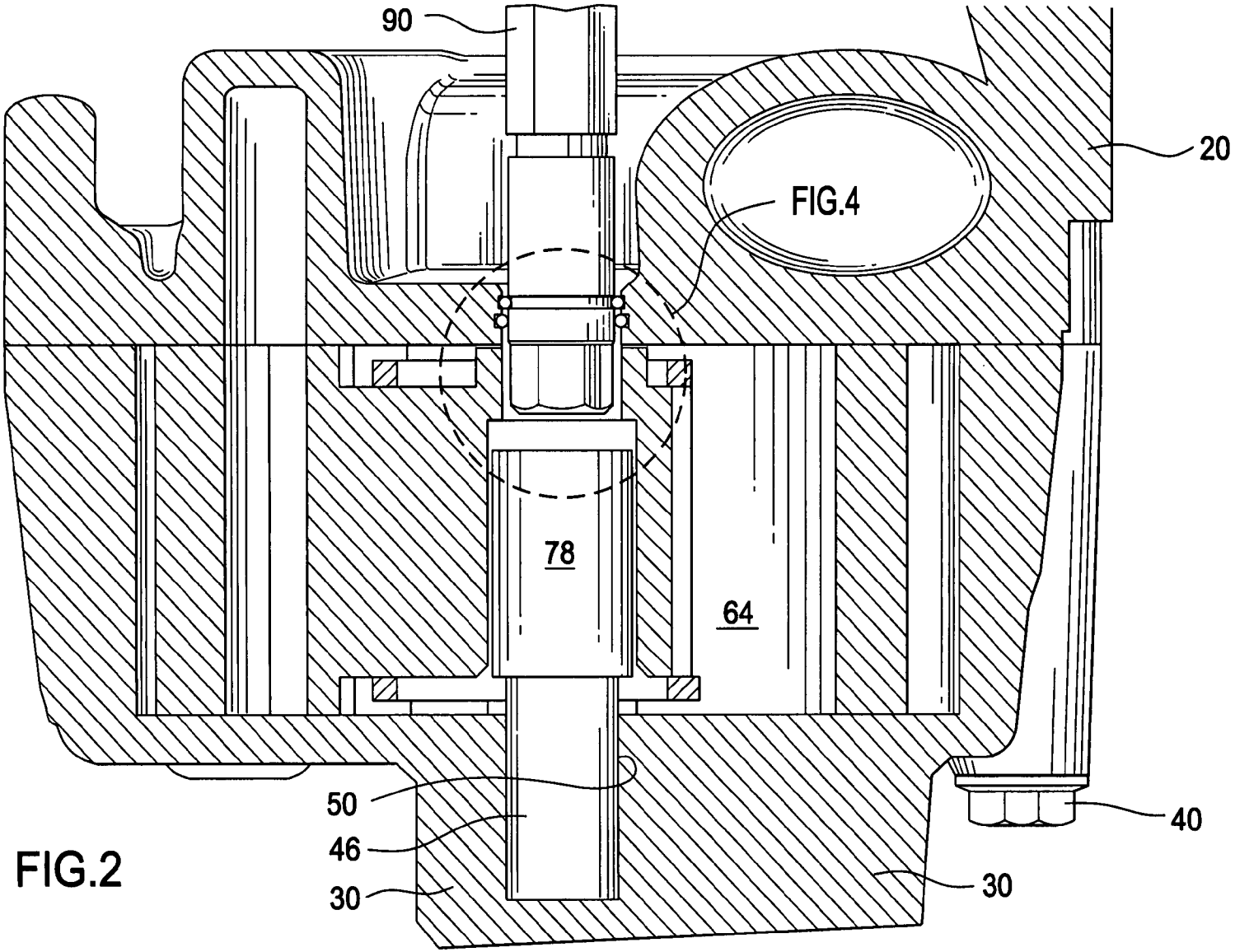
FIG. 2 is a cross-sectional detail of the vane pump shown in FIG. 1.

FIG. 2 is a cross-sectional detail of the vane pump shown in FIG. 1. Referring to FIG. 1 and FIG. 2, shaft 46 is press fit into case 30. To provide the necessary bearing surface, shaft 46 extends into rotor 60 approximately 50% to 90% of the distance between the inner walls 34, 38. Walls 34, 38 are substantially planar and are parallel to each other, thereby defining opposite sides of cavity 18. In the preferred embodiment the shaft extends in excess of approximately 75% of the distance between the walls 34, 38.

Rotor 60 is located within the cavity 18. Cavity 18 is formed between case portions 20 and 30.

Figure 3:
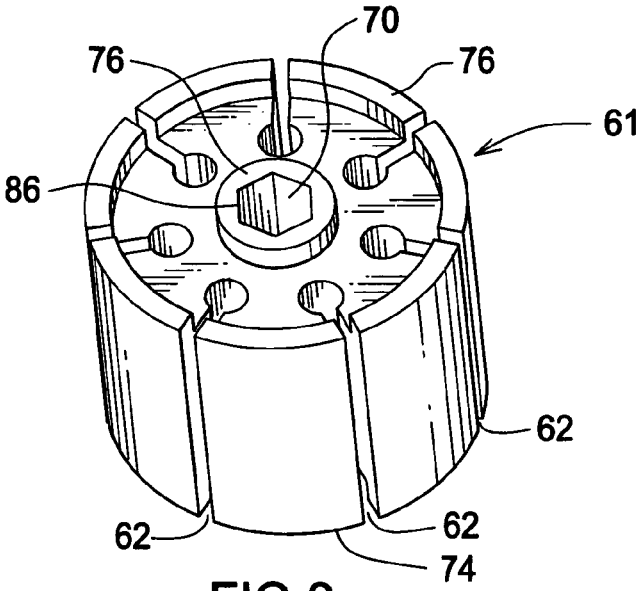
FIG. 3 is a perspective view of a rotor used in the vane pump.

Rotor 60 is typically a powdered metal component as shown in FIG. 3. Rotor 60 may also be machined from billet or cast with equal performance. Rotor 60 is generally cylindrical with a series of radial slots 62, see FIG. 3. Each slot 62 cooperatively and slidingly receives a vane 64. Vanes 64 slidingly engage with the peripheral wall 36 of cavity 18. Rotor 60 is formed with a radially outer peripheral land 74 and a radially inner peripheral land 76 extending around the bore 70 at both ends.

Rotor 60 further comprises a bore 70 which receives a bushing 78. Bushing 78 is press fit into bore 70. Bushing 78 provides a bearing surface for rotation of the rotor 60 on the shaft 46. Bushing 78 is typically a metal backed nylon bushing that is a close sliding fit on the shaft 46. In an alternate embodiment bushing 78 may be omitted. In the alternate embodiment wherein bushing 78 is omitted, shaft 46 has a sliding fit within bore 70, thereby allowing rotor 60 to spin on shaft 46. Some minor lateral movement of rotor 60 with respect to shaft 46 can occur without adversely affecting operation of the pump.

An end of bore 70 is formed in the shape of a hexagonal socket 86. Socket 86 comprises a close fit on a drive shaft 90. Shaft 90 projects through an aperture 21 in case 20. Close contact along each of the flanks of the hexagonal drive shaft is preferably obtained. This enhances the torque transmitting capabilities of the connection to the drive shaft, thereby permitting a shorter socket for a desired torque.

To assemble the pump 10, shaft 46 is pressed into bore 50 in case 30. Bushing 78 is press fit into the rotor 60. Rotor 60 and bushing 78 are then slipped onto the shaft 46. End 47 of shaft 46 is adjacent to but does not contact shoulder 87 at the intersection of the socket 86 and bore 70. This feature locates rotor 60 radially on shaft 46. Case 20 is then secured to case 30 using fasteners 40. Drive shaft 90 is inserted into the aperture 21 and into socket 86.

In operation, rotation of rotor 60 by drive shaft 90 causes fluid to be displaced from the inlet 14 to the outlet 12 by movement of vanes 64. The peripheral lands 74, 76 on the opposed end faces the rotor 60 provide dynamic seals between the ends of rotor 60 and cavity 18, thereby inhibiting leakage past the end walls 34, 38, which improves hydraulic efficiency. Lands 74, 76 eliminate the need for separate secondary seals. Each land 74, 76 axially locate and control the rotor location within the cavity 18 during operation. The "axial" direction is parallel to the axis of rotation of the rotor. It should be noted that shaft 90 only transmits torque to the rotor, and it does not serve as a means of locating and positioning rotor 60 within the cavity 18. This function is performed by the lands 74, 76 and shaft 46. It will be noted that a single bushing is utilized on the surface of the shaft 46 so that alignment of spaced bearings is not otherwise required. Moreover, the provision of the bushing 78 engaged with shaft 46 allows the rotor to "float" in the cavity 18 which allows the rotor to find a natural equilibrium during operation within the cavity. This in turn allows the clearance between the end walls 34, 38 defining the cavity 18 to be further reduced compared to the use of a pair of bearings at each end of a shaft, again, enhancing the hydraulic efficiency. Put another way, rotor 60 is similar to a "bearing" as it spins and floats between walls 34, 38.

Use of a hexagonal socket 86 in rotor 60 avoids the need for heat treating of the rotor 60 to prevent "round out" of the socket. The simple sliding fit of the rotor 60 on the shaft 46 also avoids the need for exotic materials otherwise necessary for the rotor to withstand the press fit of a conventional shaft arrangement.

The arrangement of the pump described above eliminates the potential misalignment of a pair of bearings that may be conventionally used, which facilitates manufacture and assembly. Although the clearances are tighter, the instant arrangement easily accommodates a normal engine operating temperature range of approximately −40° C. to +130° C. whilst maintaining reduced tolerances. A reduction in driving torque in the range of approximately 5% to 10% can be achieved by the inventive pump as compared to conventional arrangements.

FIG. 3 is a perspective view of a rotor used in the vane pump. Rotor 60 comprises socket 86 and radial slots 62. Each radial slot 62 slidingly receives a vane 64, see FIG. 2. Each vane 64 moves freely within each slot 62, while the movement is constrained by the inner surfaces of case 20 and case 30. Lands 74, 76 are disposed about a circumference of rotor 60.

In the preferred embodiment rotor 60 comprises a powdered metal or alloy compact. This allows the inventive design to take advantage of the "as pressed" geometry for the rotor. The green rotor compact is then sintered using known methods. Consequently, the rotor only requires minor surface finishing for final operating clearances.

Figure 4:
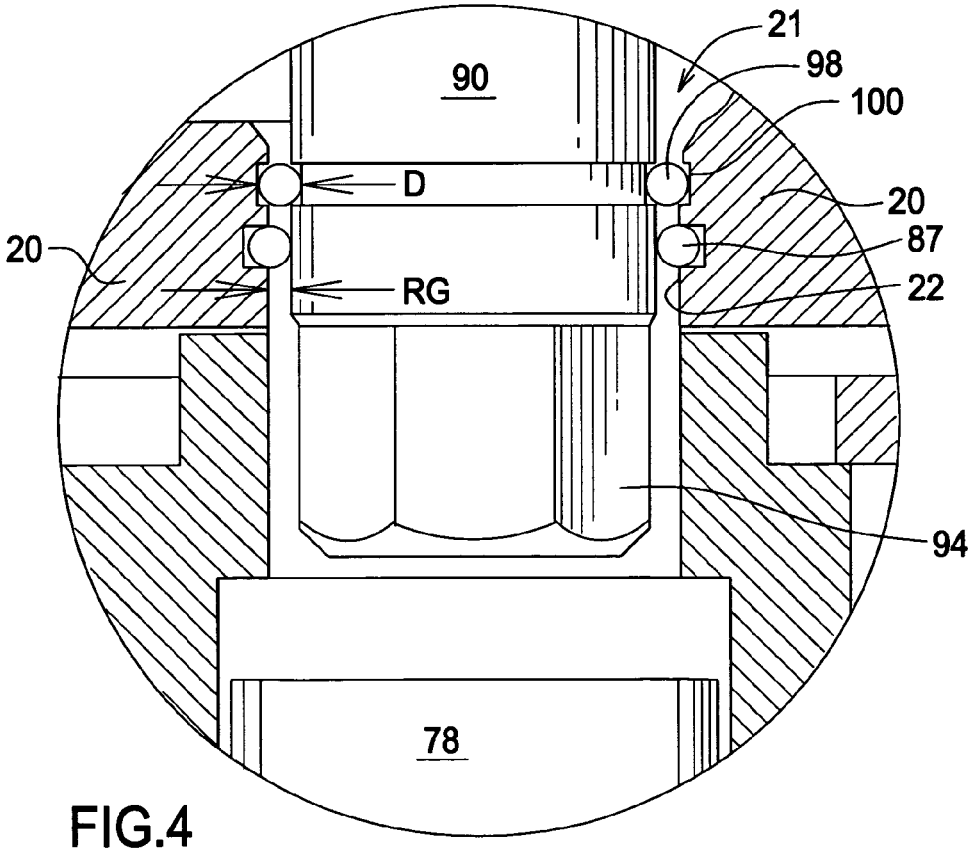
FIG. 4 is a cross-sectional detail of the vane pump shown in FIG. 1.

FIG. 4 is a cross-sectional detail of the vane pump shown in FIG. 1. Drive shaft engages aperture 21 with a loose fit having a relatively large clearance between the shaft 90 and the inner surface 22 of aperture 21, for example, from approximately 1 to 3 mms. Drive shaft 90 is loosely secured in case 20 by means of a circumferential groove (surface feature) 94 in shaft 90. Snap ring 98 is disposed a circumferential groove (surface feature) 100 within case 20. Groove 100 is a sufficient depth to allow ring 98 to expand as shaft 90 is inserted.

Once the shaft 90 is inserted though aperture 21, ring 98 engages with groove 94. The diameter "D" of ring 98 exceeds the radial gap "RG". This inhibits further axial movement to the shaft 90 with respect to case 20, thereby mechanically retaining the shaft in the case and avoiding loss of engagement of shaft 90 with socket 86 in rotor 60 during shipping. It will be noted that the shaft 90 is freely rotatable in case 20 with limited axial movement to accommodate connection to the engine and ensure no interference or contact with the shaft 46 once the pump is completely installed.

Figure 5:
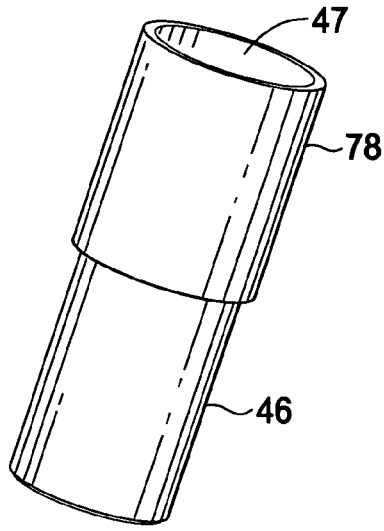
FIG. 5 is a perspective view of the shaft.

FIG. 5 is a perspective view of the shaft. Bushing 78 is shown engaged with shaft 46. Rotor 60 is omitted form this view. Shaft 46 is press fit into case 30.

Figure 6:
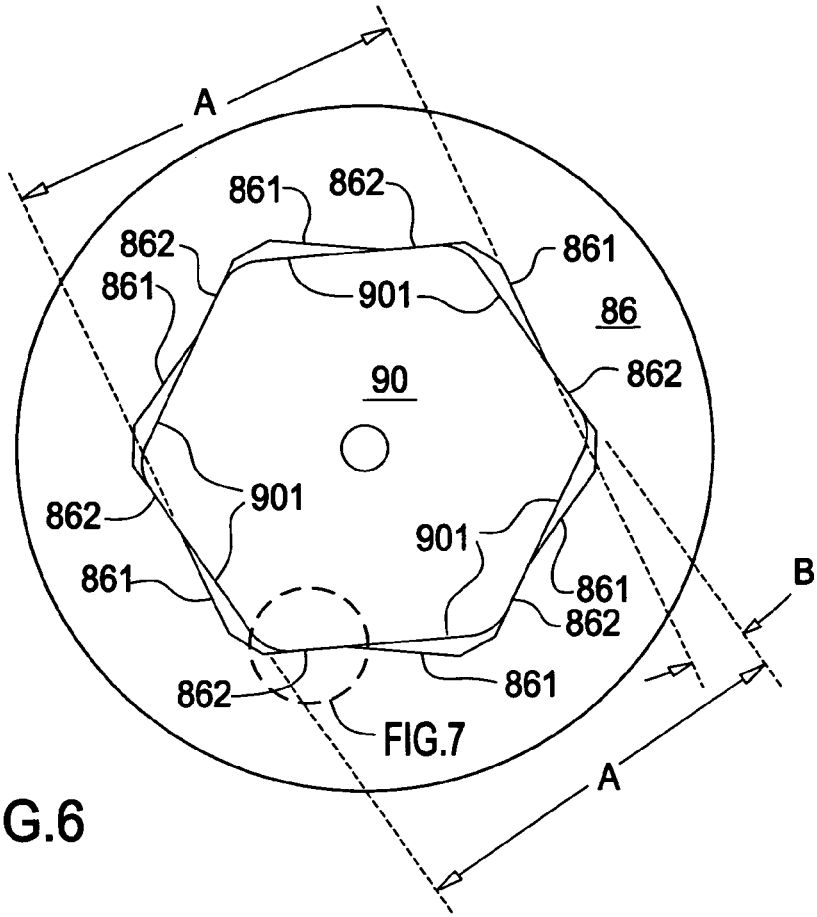
FIG. 6 is a plan view of the connection between the shaft and the rotor.

FIG. 6 is a plan view of the connection between the shaft and the rotor. Hexagonal socket 86 is engaged with drive shaft 90. Shaft 90 has a hexagonal form which comprises six flats 901. Each of the six sides of socket 86 are split mid-point and angled with respect to the shaft 90 by angle "B". Angle "B" between adjacent surfaces 861 and 862 is in the range of approximately +0° to approximately 15°. Therefore, hexagonal socket 86 comprises six pairs of adjacent surfaces 861 and 862. Surfaces 861 disposed opposite each other across the socket are separated by dimension "A". Dimension "A" also applies to opposing surfaces 862.

Figure 7:
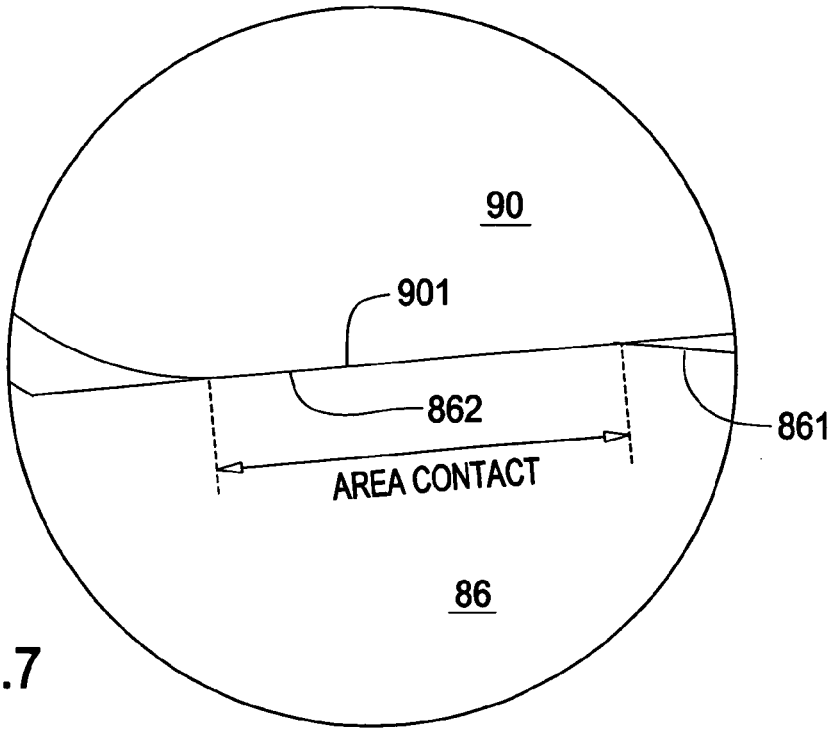
FIG. 7 is a detail of FIG. 6.

Clearance between the socket 86 and the shaft 90 is compensated for with the "B" angle to provide an area contact rather than a line contact between shaft 90 and socket 86, see FIG. 7. The area contact increases the torque that can be transmitted before the material stress limit is reached. This is an improvement over the prior art which teaches a simple line contact between the corners of the shaft 90 and the hexagonal socket 86 which can be caused by manufacturing variances.

FIG. 7 is a detail of FIG. 6. Surface 901 is in area contact with surface 862.

Figure 8:
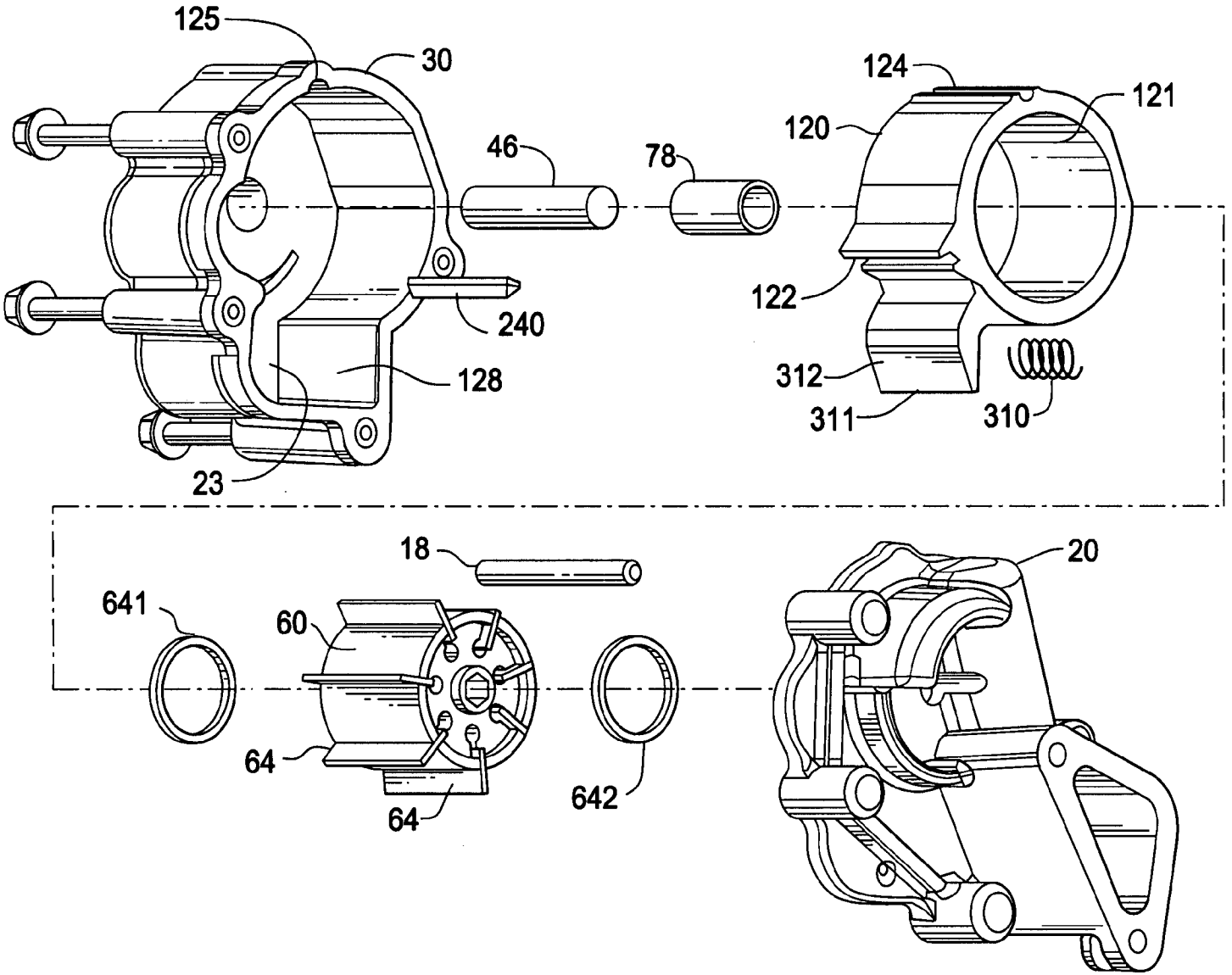
FIG. 8 is an exploded view of the pump.

FIG. 8 is an exploded view of the pump. Rotor 60 and member 120 are disposed within case 30 and case 20. Slide 120 comprises inner surface 121. An outer edge of each vane 64 slidingly engages inner surface 121. Inner surface 121 is cylindrical, but the shape of the surface can be slightly distorted to accommodate design geometries, for example to an oval or egg-shaped form. Pivot 18 engages detent 124. Groove 122 receives seal member 240 for sealing a fluid pressure within chamber 23. Spring 310 bears upon member 311 and surface 128. Seal member 240 may comprise any material having a suitable compatibility with the pump fluid, for example, synthetic and/or natural rubbers. Oil pressure is used to adjust a position of slide 120 within case 20. Oil pressure is applied to a surface 312 to impart a force against the force of spring 310, thereby adjusting the pump output. Rings 641 and 642 control the position of each vane 64.

Although a form of the invention has been described herein, it will be obvious to those skilled in the art that variations may be made in the construction and relation of parts without departing from the spirit and scope of the invention described herein.

We claim:

1. A vane pump comprising:

a case;

a rotor disposed in the case, the rotor having a bore;

a plurality of vanes radially moveable with respect to the rotor extend from the rotor;

a drive shaft engaged with the bore;

a second shaft fixedly connected to the case and extending from the case to slidingly engage the bore;

a land extending from each end of the rotor, each land cooperating with the case to seal a fluid flow, and each land further axially controlling a rotor position within the case by a sliding engagement; and the drive shaft retainable in a predetermined position with respect to the case.

2. The vane pump as in claim 1, wherein the rotor further comprises a bushing for engaging the second shaft.

3. The vane pump as in claim 1, wherein the drive shaft engages a hexagonal socket in the bore.

4. The vane pump as in claim 1, wherein the drive shaft comprises a first surface feature and the case comprises a second surface feature cooperatively disposed with the first surface feature, a retaining member cooperatively engagable with the first surface feature and the second surface feature to retain the drive shaft in the case.

5. The vane pump as in claim 1 further comprising a second land extending from each end of the rotor, the second land cooperating with the case to seal a fluid flow.

6. The vane pump as in claim 1, wherein the bore further comprises at least one pair of adjacent surfaces for engaging the drive shaft, the adjacent surfaces having an angle (B) therebetween.

7. The vane pump as in claim 6, wherein the angle (B) is in the range of approximately +0° to approximately 15° .

* * * * *